US009003604B2

(12) United States Patent
Matsuki

(10) Patent No.: US 9,003,604 B2
(45) Date of Patent: Apr. 14, 2015

(54) DOOR CHECKER FOR AUTOMOBILE

(71) Applicant: Rikenkaki Kogyo Kabushiki Kaisha, Sakado-Shi, Saitama (JP)

(72) Inventor: Katsuhiro Matsuki, Sakado (JP)

(73) Assignee: Rikenkaki Kogyo Kabushiki Kaisha, Saitama (JP)

( * ) Notice: Subject to any disclaimer, the term of this patent is extended or adjusted under 35 U.S.C. 154(b) by 0 days.

(21) Appl. No.: 14/010,874

(22) Filed: Aug. 27, 2013

(65) Prior Publication Data

US 2014/0059802 A1 Mar. 6, 2014

(30) Foreign Application Priority Data

Aug. 31, 2012 (JP) ..... 2012-191557

(51) Int. Cl.
*E05C 17/22* (2006.01)
*E05F 5/02* (2006.01)
*E05C 17/20* (2006.01)

(52) U.S. Cl.
CPC ..... *E05F 5/025* (2013.01); *Y10T 16/61* (2015.01); *E05C 17/203* (2013.01)

(58) Field of Classification Search
CPC ..... E05Y 2900/531; E05C 17/203
USPC ..... 16/86 B, 86 C
See application file for complete search history.

(56) References Cited

U.S. PATENT DOCUMENTS

| | | | | |
|---|---|---|---|---|
| 6,728,993 | B1 * | 5/2004 | Murayama | 16/342 |
| 7,383,614 | B2 * | 6/2008 | Matsuki | 16/86 B |
| 7,861,372 | B2 * | 1/2011 | Tashima et al. | 16/86 C |
| 2004/0075285 | A1 * | 4/2004 | Murayama et al. | 292/265 |
| 2004/0111832 | A1 * | 6/2004 | Murayama et al. | 16/82 |
| 2004/0251696 | A1 * | 12/2004 | Murayama et al. | 292/262 |
| 2006/0150367 | A1 * | 7/2006 | Matsuki | 16/86 C |

FOREIGN PATENT DOCUMENTS

JP H06-35562 U 5/1994

* cited by examiner

*Primary Examiner* — Victor Batson
*Assistant Examiner* — Matthew Sullivan
(74) *Attorney, Agent, or Firm* — Carrier Blackman & Associates, P.C.; Joseph P. Carrier; Anne G. Sabourin

(57) ABSTRACT

In a door checker for automobile which is applicable to vehicles having different full open angles of doors, and which makes no chattering noise by vibration, a free end portion of a check lever plate is provided with a core plate exposed portion where a core plate is exposed from a cover layer, a full open stopper mechanism includes: a stopper pin fitted in the core plate exposed portion, the stopper pin having anti-falling expanded portions; a stopper plate swingably supported on the stopper pin; and a cushion member supported by the stopper plate, and configured to cushion an impact of full opening of the door by receiving a case, and a pressing piece is provide integrally and continuously to the cover layer, the pressing piece configured to press the cushion member toward the stopper pin to thereby keep the stopper plate in contact with the stopper pin.

5 Claims, 5 Drawing Sheets

DOOR CHECKER FOR AUTOMOBILE

FIELD OF THE INVENTION

The present invention relates to an improvement of a door checker for automobile, comprising: a check lever plate turnably coupled to an automobile body, the check lever plate including a core plate made of a metal and turnably coupled to the body, and a cover layer made of a synthetic resin, covering the core plate and having an outer surface formed as a detent surface; a case fixed to a door coupled to the body in an openable and closable manner, the case pierced by the check lever plate movably relative to the check lever plate; a detent mechanism housed in the case and configured to keep the door at a predetermined open position in collaboration with the detent surface; and a full open stopper mechanism provided to the check lever plate and configured to receive the case to control a full open position of the door.

DESCRIPTION OF THE RELATED ART

Heretofore, as disclosed in Japanese Utility Model Application Publication Laid-open No. 6-35562, it has been already known that the full open stopper mechanism in such a conventional door checker for automobile is configured by including a stopper pin press-fitted into a fixing hole provided in a free end portion of the check lever plate; a stopper plate pierced by the check lever plate and supported by the stopper pin; and a cushion member supported by the stopper plate while elastically engaging with the check lever plate and configured to cushion an impact of full opening of a door by receiving the case.

SUMMARY OF THE INVENTION

In the conventional door checker for automobile, however, a relationship between the check lever plate and the stopper plate is fixed to control a predetermined full open position of a vehicle door. For this reason, for a vehicle having a different full open angle of a door, it is necessary to fabricate a door checker by newly designing the relationship between the check lever plate and the stopper plate. Hence, reduction of costs therefor is difficult. In addition, in the conventional door checker, the cushion member engages with the check lever plate just elastically. For this reason, when the automobile is running with the case positioned apart from the cushion member, the cushion member slightly moves on the check lever plate by vibration to generate a backlash (gap) between the stopper plate and the stopper pin. Due to this backlash, the stopper plate and the stopper pin may make chattering noise by vibration (chatter noise) while the automobile is running, and thereby make passengers feel uncomfortable.

The present invention has been made in view of the foregoing circumstances, and has an objective to provide a door checker for automobile which is applicable in common to vehicles having different full open angles of doors to thereby enable cost reduction, and which is capable of preventing a stopper plate and a stopper pin from making chattering noise by vibration by always keeping the stopper plate and the stopper pin in contact with each other.

In order to achieve the object, according to a first feature of the present invention, there is provided a door checker for automobile, comprising: a check lever plate turnably coupled to an automobile body, the check lever plate including a core plate made of a metal and turnably coupled to the body, and a cover layer made of a synthetic resin, covering the core plate and having an outer surface formed as a detent surface; a case fixed to a door coupled to the body in an openable and closable manner, the case pierced by the check lever plate movably relative to the check lever plate; a detent mechanism housed in the case and configured to keep the door at a predetermined open position in collaboration with the detent surface; and a full open stopper mechanism provided to the check lever plate and configured to receive the case to control a full open position of the door, wherein a free end portion of the check lever plate is provided with a core plate exposed portion where the core plate is exposed from the cover layer, the full open stopper mechanism includes: a stopper pin fitted into a fixing hole provided in the core plate exposed portion, the stopper pin having anti-falling expanded portions formed by swaging at opposite ends thereof; a stopper plate having a first through hole through which the core plate exposed portion is inserted, the stopper plate swingably supported on an outer peripheral surface of the stopper pin; and a cushion member having a second through hole through which the core plate exposed portion is inserted, the cushion member supported by the stopper plate swingably together with the stopper plate, and configured to cushion an impact of full opening of the door by receiving the case, and a pressing piece is provide integrally and continuously to the cover layer, the pressing piece configured to press the cushion member toward the stopper pin to thereby keep the stopper plate at a position in contact with the stopper pin by use of resilience of the cushion member.

According to the first aspect of the present invention, in the full open stopper mechanism in an assembled state, the pressing piece provided continuously to the cover layer of the check lever plate presses the cushion member toward the stopper pin, and the stopper plate is kept at the position in contact with the stopper pin by use of resilience of the cushion member. Thus, even when the door checker receives vibrations during transportation after the assembling or during running of an automobile to which the door checker is attached, the stopper plate does not get apart from the outer peripheral surface of the stopper pin, so that the door checker can prevent the stopper plate and the stopper pin from making chattering noise by vibration due to a backlash therebetween.

Upon fully opening of the door, the force to open the door acts on the cushion member elastically via the case and then is transmitted to and received by the stopper pin via the stopper plate. Thus, the full open position of the door is controlled. Even in the above operation, the pressing piece continuously presses the cushion member, and thereby the stopper plate is kept in contact with the outer peripheral surface of the stopper pin. In this way, impact noise can be prevented from occurring.

Moreover, the stopper plate is supported on the outer peripheral surface of the stopper pin swingably together with the cushion member as a single unit. For this reason, when the case comes into contact with the cushion member upon fully opening of the door, the cushion member and the stopper plate are self-aligned, or more specifically automatically swing with the stopper pin used as the pivot so that the entire mating surfaces of the case and the cushion member can come into contact with each other. Thereby, the cushion member can effectively absorb the impact of opening of the door. Even when the door checker is attached to an automobile having a different full open angle of a door, the cushion member and the stopper plate are capable of being self-aligned according to the full open angle. Thus, there is no need to newly design and fabricate the door checker for automobiles having different full open angles. This enables mass production of the door checkers and reduction in the costs therefor.

In addition, the absence of the cover layer on the core plate exposed portion having the fixing hole makes it possible to surely form the expanded portions of the stopper pin by swaging.

According to a second feature of the present invention, in addition to the first feature, a tip end surface of the pressing piece is formed in such an arc shape that a condition where the tip end surface presses the cushion member toward the stopper plate is made constant irrespective of the swinging of the cushion member and the stopper plate.

According to the second aspect of the present invention, wherever the cushion member and the stopper plate are self-aligned, the pressing piece of the check lever plate always continuously presses the cushion member toward the stopper plate, and thereby keeps the stopper plate at the position in contact with the stopper pin. Thus, chattering noise by vibration can be effectively prevented from occurring.

According to a third feature of the present invention, in addition to the first or second feature, an inner peripheral surface of the second through hole is provided with a recessed portion having an inner wall and opened at one end face of the cushion member on the case side, the pressing piece is inserted into the recessed portion with the tip end surface of the pressing piece pressing the inner wall, and the inner wall and the tip end surface are each formed to have a slope that is inclined to come closer to the core plate exposed portion while extending toward the stopper plate, and when a load toward the case that is larger than a predetermined value is applied to the cushion member, the inner wall and the tip end surface slide on each other and the pressing piece moves while pushing out the inner peripheral surface of the second through hole.

According to the third aspect of the present invention, in the final process of attaching the full open stopper mechanism to the core plate exposed portion, the expanded portions are formed by swaging at opposite end portions of the stopper pin inserted through the fixing hole of the core plate exposed portion. In this process, when a load toward the cushion member is applied to the stopper plate such that the stopper plate together with the cushion member can recede slightly from the stopper pin, the inclined tip end surface of the pressing piece of the check lever plate moves while sliding on the inclined inner wall of the recessed portion of the cushion member and pushing out the inner surface of the second through hole, and thereby the stopper plate can recede easily from the stopper pin. Thus, the expanded portions can be appropriately formed at opposite end portions of the stopper pin by a swaging tool without the stopper plated being damaged.

According to a fourth feature of the present invention, in addition to the first or second feature, the cushion member is provided with a resilient tongue to be in pressure contact with an outer surface of the pressing piece.

According to the fourth aspect of the present invention, the resilient tongue to be in pressure contact with the outer surface of the pressing piece is formed in the cushion member. Thus, the self-aligned position of the cushion member and the stopper plate can be kept by a friction force occurring between the pressing piece and the resilient tongue.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention is described below based on the accompanying drawings.

Figure 1:
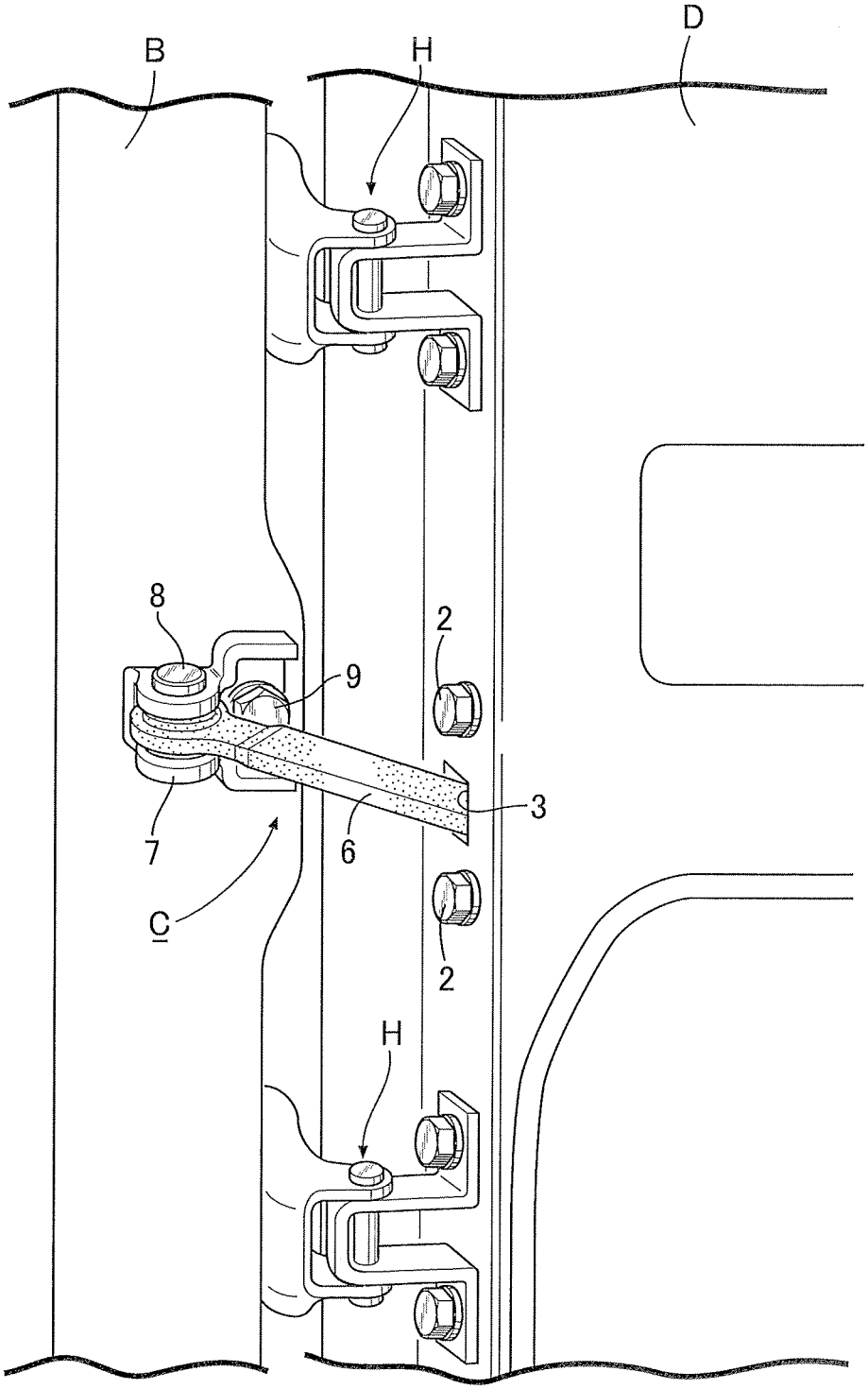
FIG. 1 is a perspective view of a principle portion of an automobile to which a door checker according to an embodiment of the present invention is attached.

In FIG. 1, a door D is turnably attached to an automobile body B with hinges H in order to open and close an opening for entering and exiting the automobile. A door checker C of the present invention is attached between the door D and the body B.

Figure 2:
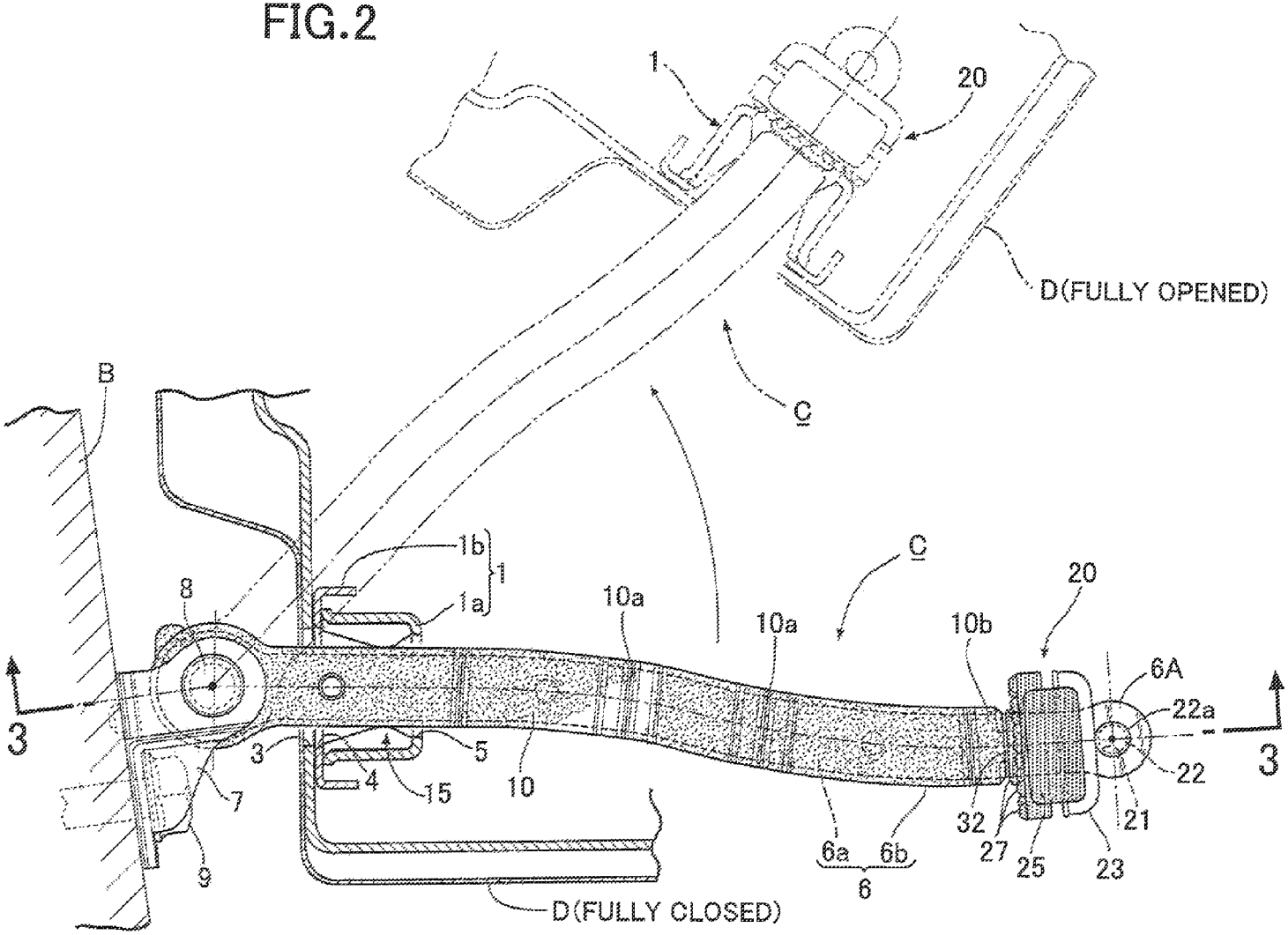
FIG. 2 is a plan view of the door checker.
Figure 3:
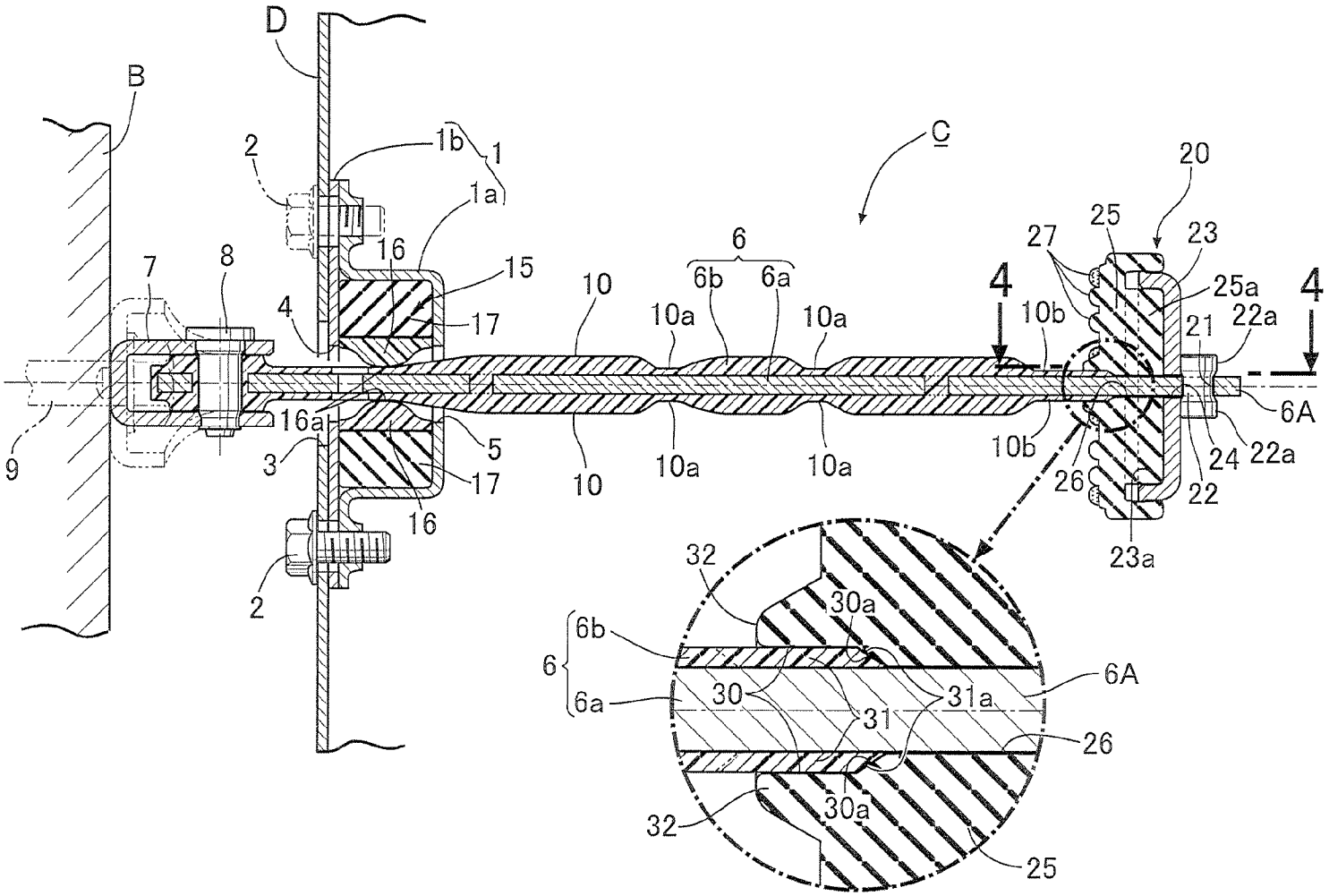
FIG. 3 is a sectional view taken along a line 3-3 in FIG. 2.

As illustrated in FIG. 2 and FIG. 3, the door checker C includes a case 1 fixed to an inner surface of an end wall of the door D. The case 1 includes a case body 1*a* in a box shape with one end opened and a cover 1*b* joined to the case body 1*a* while covering the open end of the case body 1*a*. The case body 1*a* and the cover 1*b* are fastened to the end wall of the door D with a pair of upper and lower bolts 2 with the cover 1*b* being in contact with the inner surface of the end wall. The cover 1*b* and the case body 1*a* are provided with through holes 4, 5 which are provided coaxially with a through hole 3 opened in the end wall of the door D. A base end portion of a check lever plate 6 passing through these three through holes 3, 4, 5 is turnably coupled to a bracket 7 via a pivot shaft 8. The bracket 7 is fixed to the body B with a bolt 9 with the pivot shaft 8 arranged in parallel with the pivot shafts of the hinges H.

The check lever plate 6 is arranged with its upper and lower surfaces extended substantially horizontally. The check lever plate 6 includes a core plate 6*a* made of a steel sheet and a cover layer 6*b* made of a hard synthetic resin. The core plate 6*a* is directly coupled to the bracket 7 and arranged substantially horizontally, and the cover layer 6*b* is bonded to the core plate 6*a* by molding while covering an outer surface of the core plate 6*a*. Upper and lower surfaces of the cover layer 6*b* are formed as detent surfaces 10. In each of the detent surfaces 10, one or more semi-open detent notches 10*a* are formed at an intermediate portion in a longitudinal direction thereof, and a full-open detent notch 10*b* is formed in the vicinity of a free end portion thereof.

In the case 1, a detent mechanism 15 is housed which keeps the door D at any of predetermined open positions in collaboration with the detent surfaces 10.

The detent mechanism 15 includes a pair of upper and lower detent members 16 made of a hard synthetic resin. The detent members 16 are fitted and held in the case 1 slidably in a plate-thickness direction of the check lever plate 6, and are slidable respectively on the pair of the detent surfaces 10 of the check lever plate 6. Each of the detent members 16 includes a semi-cylindrical engagement portion 16*a* capable of engaging with the semi-open detent notches 10*a* and the full-open detent notch 10*b*.

In addition, in the case 1, a pair of upper and lower resilient spring members 17 for resiliently biasing the respective detent members 16 toward the detent surfaces 10 of the check lever plate 6 are housed in a compressed state. Each of the resilient spring members 17 is made of a resilient material such as elastomer or the like. The detent members 16 and the resilient spring members 17 described above constitute the detent mechanism 15.

Figure 4:
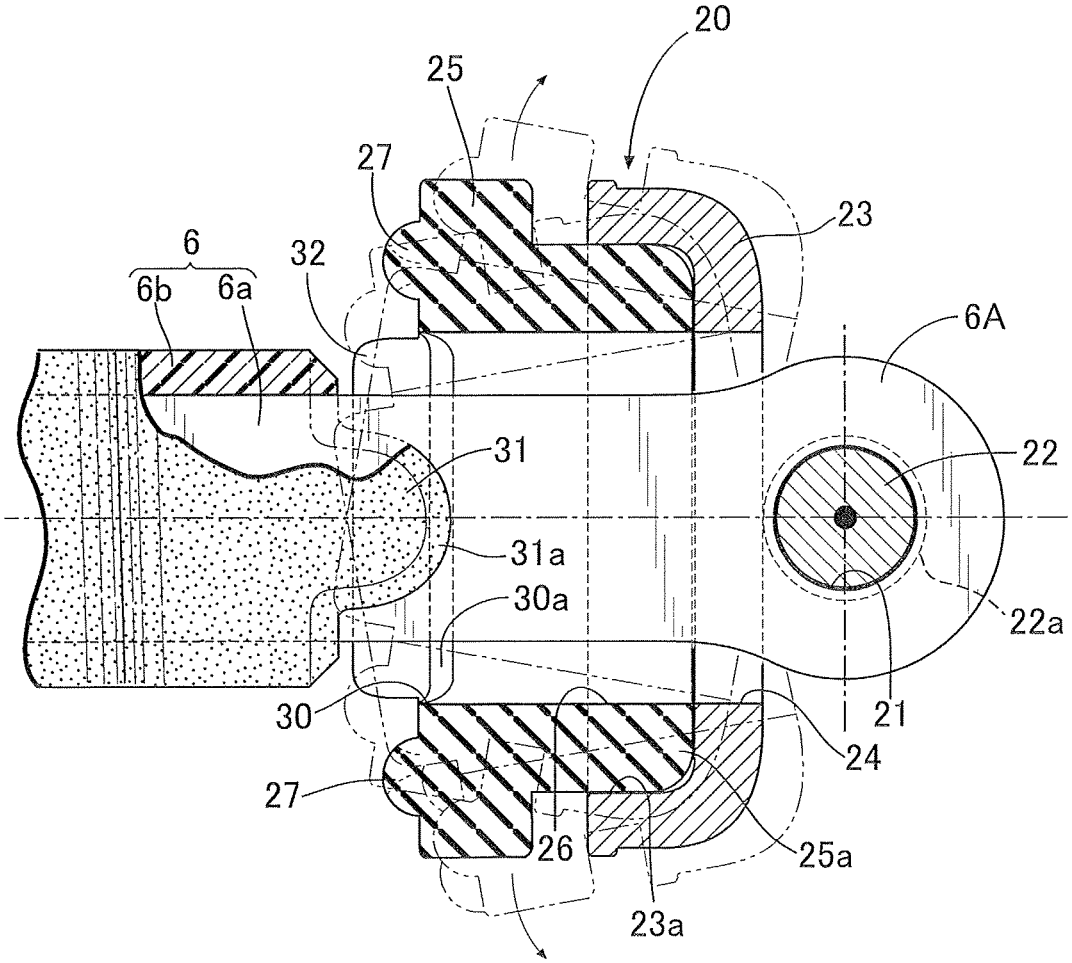
FIG. 4 is an enlarged view of a section taken along a line 4-4 in FIG. 3.

As illustrated in FIG. 3 and FIG. 4, the free end portion of the check lever plate 6 is provided with a core plate exposed portion 6A where the core plate 6*a* is exposed from the cover layer 6*b*. The core plate exposed portion 6A is provided with a full open stopper mechanism 20 which controls the full open position of the door D in collaboration with the case 1.

The full open stopper mechanism 20 includes: a stopper pin 22 fitted into a fixing hole 21 opened in the core plate exposed portion 6A, the stopper pin 22 having anti-falling expanded portions 22*a* formed by swaging at opposite end portions thereof; a stopper plate 23 including a first through hole 24 through which the core plate exposed portion 6A is loosely inserted, the stopper plate 23 being swingably supported on an outer peripheral surface of the stopper pin 22 on the case 1 side; and a cushion member 25 including a second through hole 26 through which the core plate exposed portion 6A is inserted, the cushion member 25 being supported on the stopper plate 23 swingably together with the stopper plate 23 and configured to cushion an impact of full opening of the door D. A front surface of the cushion member 25 is provided with many cushion protrusions 27 which the case 1 bumps with its impact cushioned.

The first through hole 24 of the stopper plate 23 is formed in a rectangular sectional shape corresponding to the sectional shape of the core plate exposed portion 6A, and the long side of the first through hole 24 is set sufficiently longer than the long side of the core plate exposed portion 6A so that the stopper plate 23 can turn relative to the core plate exposed portion 6A.

Likewise, the second through hole 26 of the cushion member 25 is also formed in a rectangular cross sectional shape, and the long side of the second through hole 26 is set sufficiently longer than the long side of the core plate exposed portion 6A so that the cushion member 25 can turn relative to the core plate exposed portion 6A. On the other hand, short side portions of the second through hole 26 are provided with interferences with the upper and lower surfaces of the core plate exposed portion 6A. Thus, when the cushion member 25 turns relative to the core plate exposed portion 6A, the cushion member 25 elastically rubs against the upper and lower surfaces of the core plate exposed portion 6A. The foregoing stopper plate 23 and cushion member 25 are capable of turning relative to the core plate exposed potion 6A together as a single unit in which a recessed portion 23*a* and a protruding portion 25*a* formed in mating surfaces of the stopper plate 23 and the cushion member 25 are elastically fitted to each other.

Upper and lower inner surfaces of the second through hole 26 of the cushion member 25 are provided with a pair of recessed portions 30 each including an inner wall 30*a* and opened at one end face of the cushion member 25 on the case 1 side. A pair of upper and lower pressing pieces 31 are provided integrally and continuously to the cover layer 6*b*. The pressing pieces 31 are inserted into the recessed portions 30 while pressing tip end surfaces 31*a* thereof against the inner walls 30*a*. Here, the tip end surface 31*a* of each pressing piece 31 is formed in such an arc shape that a condition where the tip end surface 31*a* of the pressing piece 31 presses the inner wall 30*a* of the recessed portion 25*a* can be made constant when the cushion member 25 turns relative to the core plate exposed portion 6A.

In addition, each of the inner walls 30*a* of the recessed portions 30 and each of the tip end surfaces 31*a* of the pressing pieces 31 pressing the inner walls 30*a* are formed to have slopes that are inclined to come closer to the core plate exposed portion 6A while extending toward the stopper plate 23.

Moreover, the recessed portions 30 are provided with resilient interferences with the pressing pieces 31, respectively. Thus, when the cushion member 25 turns relative to the core plate exposed portion 6A, frictions occur between inner surfaces of the recessed portions 30 and the pressing pieces 31. Further, a pair of upper and lower resilient tongues 32 to be in pressure contact with outer surfaces of the pressing pieces 31, respectively, are provided integrally to the cushion member 25.

Next, operations of this embodiment are described.

In assembling of the door checker C, the case 1 and the detent mechanism 15 are firstly attached to the check lever plate 6, and then the full open stopper mechanism 20 is attached to the check lever plate 6. In the full open stopper mechanism 20 in an assembled state, the pair of upper and lower pressing pieces 31 of the check lever plate 6 are press-fitted into the pair of upper and lower recessed portions 30 of the cushion member 25 under light pressure, while pressing the tip end surfaces 31*a* against the inner walls 30*a* of the recessed portions 30, thereby causing the cushion member 25 to deform compressively. By using its own resilience, the cushion member 25 presses the stopper plate 23 against the outer peripheral surface of the stopper pin 22, and thereby keeps the stopper plate 23 in contact with the outer peripheral surface. Thus, even when the door checker C receives vibrations during transportation after the assembling or during running of an automobile to which the door checker C is attached, the stopper plate 23 does not get apart from the outer peripheral surface of the stopper pin 22, so that the door checker C can prevent the stopper plate 23 and the stopper pin 22 from making vibration noise due to a backlash therebetween.

In the process of opening the door D from a full close position, the case 1 moves toward the free end portion of the check lever plate 6 and the check lever plate 6 turns about the pivot shaft 8. Then, along with the aforementioned movement of the case 1, the engagement portions 16*a* of the detent members 16 slide on the detent surfaces 10 of the check lever plate 6. When the door D reaches a predetermined semi-open position, the resilience of the resilient spring members 17 causes the engagement portions 16*a* of the detent members 16 to fall into the semi-open detent notches 10*a* of the check lever plate 6, whereby the torque to open the door D increases sharply, so that the door D can be kept at the predetermined semi-open position.

Then, further application of a force to open the door D causes the engagement portions 16*a* of the detent members 16 to get out of the semi-open detent notches 10*a*. When the door D reaches a predetermined full open position, the engagement portions 16*a* fall into the full-open detent notches 10*b* at this time, and simultaneously the force to open the door D acts on the cushion member 25 elastically via the case 1 and then is transmitted to and received by the stopper pin 22 via the stopper plate 23. Thus, the full open position of the door D is controlled. Even in the above operation, the pressing pieces 31 continuously press the inner walls 30*a* and thereby the stopper plate 23 is kept in contact with the outer peripheral surface of the stopper pin 22. In this way, impact noise can be prevented from occurring.

Moreover, the stopper plate 23 is supported on the outer peripheral surface of the stopper pin 22 swingably together with the cushion member 25 as a single unit. For this reason, when the case 1 comes into contact with the cushion member 25 upon fully opening of the door D, the cushion member 25 and the stopper plate 23 are self-aligned, or more specifically automatically swing with the stopper pin 22 used as the pivot so that the entire mating surfaces of the case 1 and the cushion member 25 can come into contact with each other. Thereby, the cushion member 25 can effectively absorb the impact of opening of the door D. Even when the door checker C is attached to an automobile having a different full open angle of a door D, the cushion member 25 and the stopper plate 23 are capable of being self-aligned according to the full open angle. Thus, there is no need to newly design and fabricate the door checkers C for automobiles having different full open angles. This enables mass production of the door checkers C and reduction in the costs therefor. Needless to say, the cushion member 25 and the stopper plate 23 are also self-aligned properly even if the full open angle of the door D varies due to manufacturing errors.

In addition, the self-aligned position of the cushion member 25 and the stopper plate 23 is kept by a friction force occurring between the cushion member 25 and the core plate exposed portion 6A, and thereby is prevented from changing immoderately. Further, wherever the cushion member 25 and the stopper plate 23 are self-aligned, the pressing pieces 31 of the check lever plate 6 always press the inner walls 30*a* of the cushion member 25 and thereby keep the stopper plate 23 at the position in contact with the stopper pin 22. Thus, chattering noise by vibration can be prevented from occurring.

Furthermore, since the pair of upper and lower resilient tongues 32 to be in pressure contact with the respective outer surfaces of the pressing pieces 31 are formed integrally with the cushion member 25, the cushion member 25 and the stopper plate 23 can be kept at the self-aligned position by use of friction forces between the pressing pieces 31 and the resilient tongues 32.

Figure 5:
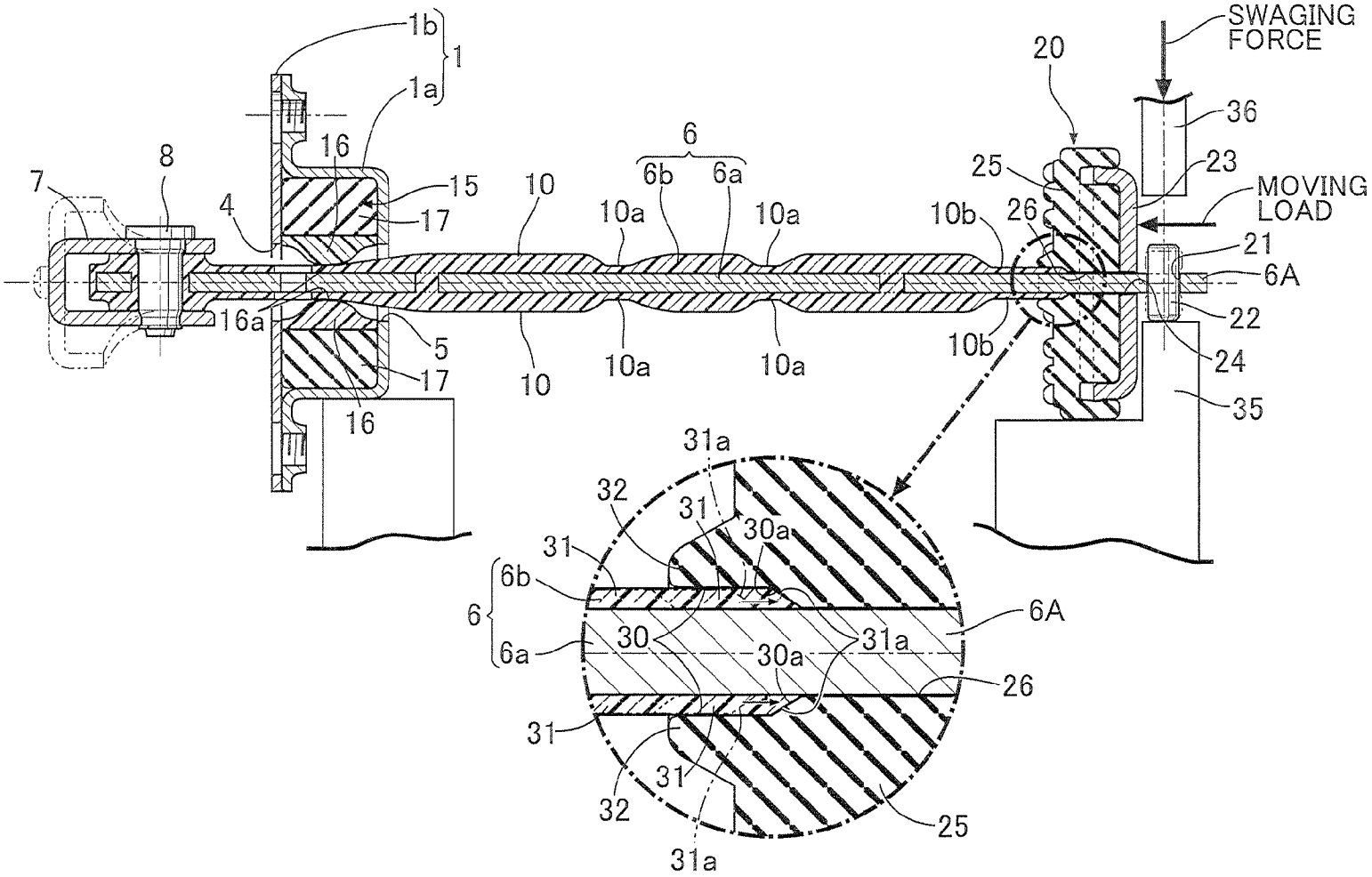
FIG. 5 is an explanatory view for a process of swaging a stopper pin.

As illustrated in FIG. 5, in the final process of attaching the full open stopper mechanism 20 to the core plate exposed portion 6A, the anti-falling expanded portions 22*a* need to be formed at opposite ends of the stopper pin 22 inserted through the fixing hole 21 of the core plate exposed portion 6A, by pressing an upper end of the stopper pin 22 with a swaging die 36 while receiving a bottom end of the stopper pin 22 on a swaging base 35. In this process, in order to prevent the swaging base 35 and the swaging die 36 from damaging the stopper plate 23 adjacent to the stopper pin 22, a load toward the cushion member 25 is applied to the stopper plate 23 such that the stopper plate 23 together with the cushion member 25 can recede slightly from the stopper pin 22. With the application of this load, the inclined tip end surfaces 31*a* of the pressing pieces 31 of the check lever plate 6 move while sliding on the inclined inner walls 30*a* of the recessed portions 30 of the cushion member 25 and pushing out the inner surface of the second through hole 26, and thereby the stopper plate 23 can recede easily from the stopper pin 22. Thus, the expanded portions 22*a* can be appropriately formed by swaging in the stopper pin 22. The absence of the cover layer 6*b* on the core plate exposed portion 6A having the fixing hole 21, in particular, makes it possible to surely form the expanded portions 22*a* of the stopper pin 22 by swaging. When a load for returning the cushion member 25 toward the stopper pin 22 is applied to the cushion member 25 after the swaging of the stopper pin 22, the tip end surfaces 31*a* of the pressing pieces 31 of the check lever plate 6 are restored and press the inner walls 30*a* of the recessed portions 30 of the cushion member 25, and thereby get back to the normal state of keeping the stopper plate 23 at the position in contact with the outer peripheral surface of the stopper pin 22.

The present invention is not limited to the foregoing embodiment, but may be altered in design variously without departing from the gist of the present invention. For example, the recessed portions 30 and the pressing pieces 31 are provided as pairs on the upper and lower sides in the foregoing embodiment, but may be provide on only one of the upper and lower sides.

What is claimed is:

1. A door checker for automobile, comprising:

a check lever plate turnably coupled to an automobile body, the check lever plate including a core plate made of a metal and turnably coupled to the body, and a cover layer made of a synthetic resin, covering the core plate and having an outer surface formed as a detent surface;

a case fixed to a door coupled to the body in an openable and closable manner, the case pierced by the check lever plate movably relative to the check lever plate;

a detent mechanism housed in the case that keeps the door at a predetermined open position in collaboration with the detent surface; and a full open stopper mechanism provided to the check lever plate and that receives the case, wherein a free end portion of the check lever plate is provided with a core plate exposed portion where the core plate is exposed from the cover layer, the full open stopper mechanism includes:

a stopper pin fitted into a fixing hole provided in the core plate exposed portion, the stopper pin having swaged expanded portions at opposite ends thereof;

a stopper plate having a first through hole through which the core plate exposed portion is inserted; and a cushion member having a second through hole through which the core plate exposed portion is inserted, and an inner peripheral surface of the second through hole is provided with a recessed portion having an inner wall and opened at one end face of the cushion member on the case side, the recessed portion being extended over a substantially full length in a widthwise direction of the second through hole, and the cushion member is aligned with and supported by the stopper plate, and the stopper plate and cushion member are swingably supported on an outer peripheral surface of the stopper pin, and the cushion member cushions an impact of full opening of the door by receiving the case, and a pair of upper and lower pressing pieces are provided integrally and continuously to the cover layer, such that a pressing piece is provided on each of opposite sides of the check lever plate, wherein each pressing piece comprises a tip end surface formed in an arc shape that presses the cushion member toward the stopper pin continuously, to maintain contact between the stopper plate and the stopper pin by use of resilience of the cushion member, irrespective of swinging of the cushion member and stopper plate, and the recessed portion of the inner peripheral portion of the second through hole receives the pressing piece, and said pressing piece has its tip end surface formed to have a narrowed width in the widthwise direction of the second through hole, the tip end surface being in contact with part of the recessed portion in the widthwise direction of the second through hole.

2. The door checker for automobile according to claim 1, wherein an inner peripheral surface of the second through hole is provided with a recessed portion having an inner wall and opened at one end face of the cushion member on the case side, the pressing piece is inserted into the recessed portion with the tip end surface of the pressing piece pressing the inner wall, and the inner wall and the tip end surface are each formed to have a slope that is inclined to come closer to the core plate exposed portion while extending toward the stopper plate, and when a load toward the case that is larger than a predetermined value is applied to the cushion member, the inner wall and the tip end surface slide on each other and the pressing piece moves while pushing out the inner peripheral surface of the second through hole.

3. The door checker for automobile according to claim 1, wherein the cushion member further comprises a resilient tongue to be in pressure contact with an outer surface of the pressing piece.

4. The door checker for automobile according to claim 2, wherein the cushion member further comprises a resilient tongue to be in pressure contact with an outer surface of the pressing piece.

5. The door checker for automobile according to claim 1, wherein the inner peripheral surface of the second through hole is provided with a recessed portion having an inner wall and opened at one end face of the cushion member on the case side, the pressing piece is inserted into the recessed portion with the tip end surface of the pressing piece pressing the inner wall, and the inner wall and the tip end surface are each formed to have a slope that is inclined to come closer to the core plate exposed portion while extending toward the stopper plate, and when a load toward the case that is larger than a predetermined value is applied to the cushion member, the inner wall and the tip end surface slide on each other and the pressing piece moves while pushing out the inner peripheral surface of the second through hole.

* * * * *